US010932020B2

(12) United States Patent
Gu

(10) Patent No.: US 10,932,020 B2
(45) Date of Patent: Feb. 23, 2021

(54) SOUND GENERATOR

(71) Applicant: AAC Technologies Pte. Ltd., Singapore (SG)

(72) Inventor: Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,147

(22) Filed: Jul. 28, 2019

(65) Prior Publication Data

US 2020/0045394 A1 Feb. 6, 2020

(30) Foreign Application Priority Data

Aug. 1, 2018 (CN) ..... 201821241472.6

(51) Int. Cl.

| | |
|---|---|
| ***H04R 1/02*** | (2006.01) |
| ***H04R 1/28*** | (2006.01) |
| ***H04R 7/04*** | (2006.01) |
| ***H04R 9/04*** | (2006.01) |
| ***H04R 9/06*** | (2006.01) |
| ***H04R 7/16*** | (2006.01) |

(52) U.S. Cl.

CPC ..... *H04R 1/023* (2013.01); *H04R 7/04* (2013.01); *H04R 7/16* (2013.01); *H04R 9/045* (2013.01); *H04R 9/06* (2013.01); *H04R 2499/11* (2013.01)

(58) Field of Classification Search

CPC ..... H04R 1/02; H04R 1/28; H04R 1/0251; H04R 1/026

USPC ..... 381/333–334, 345, 386

See application file for complete search history.

(56) References Cited

U.S. PATENT DOCUMENTS

| | | | | |
|---|---|---|---|---|
| 6,526,150 | B2 * | 2/2003 | Kelly | H04M 1/03 379/430 |
| 2007/0144883 | A1 * | 6/2007 | Guo | H01H 9/0214 200/296 |
| 2008/0057305 | A1 * | 3/2008 | Grose | B29C 65/544 428/343 |

* cited by examiner

*Primary Examiner* — Suhan Ni
(74) *Attorney, Agent, or Firm* — W&G Law Group LLP

(57) ABSTRACT

The present invention provides a sound generator. The sound generator of the present disclosure is characterized in that the front cover hollows to form the glue slot which is around and communicated with the positioning holes. After being filled into the glue slot, the glue flows into the gap between the melting point posts and the positioning holes for filling. Therefore the horizontal sway of the front cover is reduced and even avoided, and then the front cover is fixed stably. At the same time, with the gap, the glue can flow to the position between the frame and the front cover, which increases the fixing strength and stability between the front cover and the frame with the melting points as well as the tensile property of the front cover, and therefore the acoustic stability of the sound generator is further optimized.

8 Claims, 2 Drawing Sheets

SOUND GENERATOR

FIELD OF THE PRESENT DISCLOSURE

The embodiments of the invention relate to the electroacoustic components, in particular to a sound generator used in a portable device.

DESCRIPTION OF RELATED ART

Sound generators, also called sound generators, are widely used in portable electronic devices such as mobile phones, laptops, etc. With the rapid development of these portable electronic devices, people have higher and higher requirements for the performance of the sound generators. In addition, with the thinning development of mobile phones, the quality requirements for the sound generators in the mobile phones are becoming higher and higher. The sound generator is a playing device of the voice function and therefore its internal magnetic circuit system directly influences the improvement of the acoustic performance of the product.

The sound generator of the relevant technology comprises a frame, a vibration system fixed on the frame, a magnetic circuit system driving the vibration system to vibrate and a front cover fixed on the frame. The frame extends towards the front cover to form melting point posts, and the front cover is provided with through positioning holes which cooperate with the melting point posts. The melting point posts pass through the positioning holes and then hot pressed to fix the front cover and the frame.

However, in the sound generator of the relevant technology, the front cover takes the melting point surface where the melting point posts are hot pressed as a plane but doesn't use melting points for glue filling, which limits the stability of the front cover and even influences the acoustic performance of the speaker.

Therefore, it is necessary to provide an improved sound generator to solve the above technical problems.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to exemplary embodiment. To make the technical problems to be solved, technical solutions and beneficial effects of the present disclosure more apparent, the present disclosure is described in further detail together with the figures and the embodiment. It should be understood the specific embodiment described hereby are only to explain the disclosure, not intended to limit the disclosure.

The following specific embodiment is provided to make the readers understand the contents of the present disclosure clearer and more thoroughly but not restrict the present disclosure, wherein, the upper, lower, left and right words indicating directions only refer to the position of the structure shown in the corresponding figure. The one near the center of the sound generator is defined inner side, and the one far from the center of the sound generator is defined the outer side.

Figure 1:
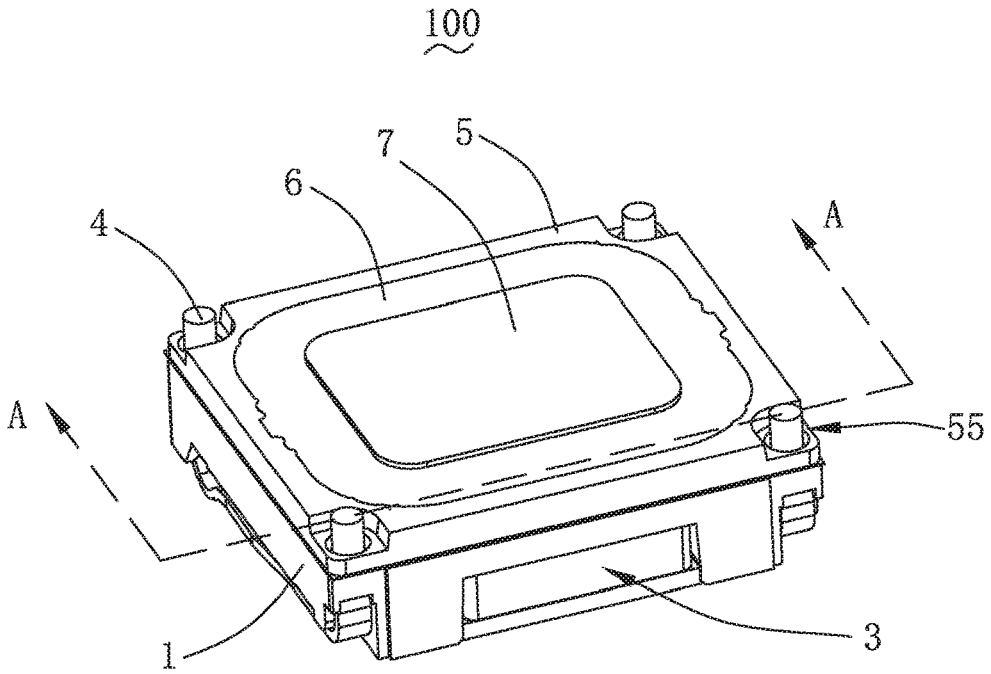
FIG. 1 is an isometric view of a sound generator in accordance with an exemplary embodiment of the invention.
Figure 2:
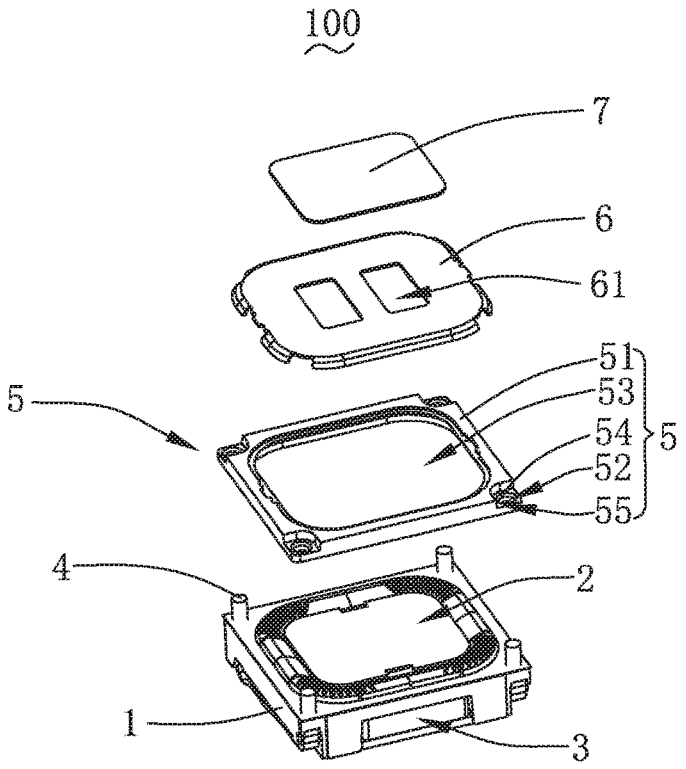
FIG. 2 an isometric and partially exploded view of the sound generator in FIG. 1.
Figure 3:
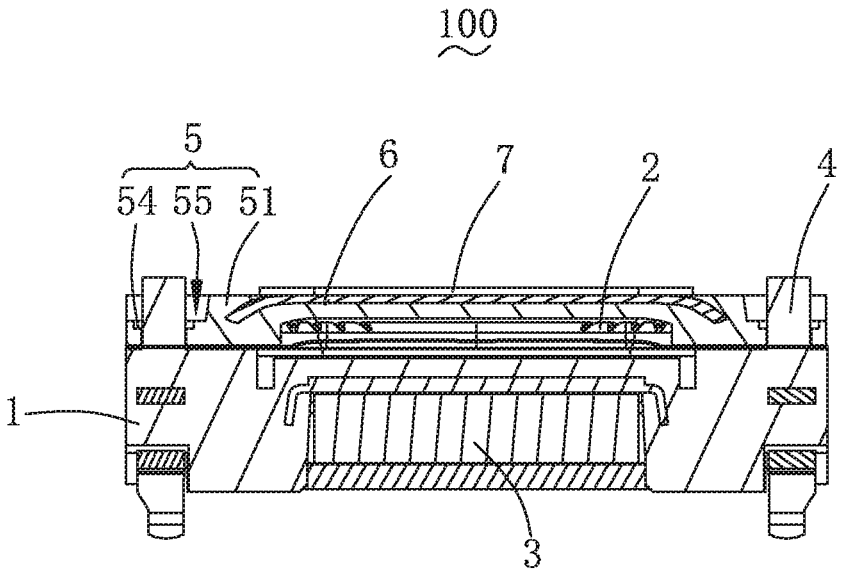
FIG. 3 is a cross-sectional view of the sound generator, taken along line A-A in FIG. 1.

Please refer to FIGS. 1-3, the present disclosure provides a sound generator 100 which comprises a frame 1, a vibration system 2, a magnetic circuit system 3, melting point posts 4 and a front cover 5.

In the embodiment, a rectangular frame 1 is taken as the example for description. Of course, the frame 1 can be circular or in any other shape without limitation.

The vibration system 2 and the magnetic circuit system 3 are respectively fixed on the frame 1, and the magnetic circuit system 3 is used for driving the vibration system 2 to vibrate to speak. The frame 1, the vibration system 2 and the magnetic circuit system 3 are jointly enclosed for forming a rear chamber (unlabeled) for improving the low-frequency acoustic performance of the sound generator 100.

The melting point posts 4 are such formed that the frame 1 extends towards the front cover 5 so as to fix the front cover 5 on the frame 1.

In the embodiment, the sound generator comprises four melting point posts 4 which are mutually separated but the number is not only limited to four. The four melting point posts 4 are respectively arranged at the four corners of the frame 1.

The front cover 5 covers the frame 1. The front cover 5 and the vibration system 2 cooperatively form a front chamber 10 for radiating sound.

Specifically, the front cover 5 comprises a body part 51, a plurality of positioning holes 52, a sound outlet 53, a glue slot 54 and a melting point groove 55.

The body part 51 covers the frame 1. The positioning holes 52 pass through the body part 51 and cooperate with the melting point posts 4. The number of the positioning holes 52 is same as that of the melting point posts 4. Each melting point post 4 is inserted into and passes through one corresponding positioning hole 52. The end of each melting point post 4 is capable of being deformed by hot pressing process to form a clasp structure so as to fix the front cover 5 on the frame 1.

The sound outlet 53 passes through the body part 51 and communicates with the front chamber 10 for radiating sound.

The side of the body part 51 away from the frame 1 forms the glue slot 54 by recessing inwardly. In the embodiment, the glue slot 54 is annular and around the positioning holes 52 and communicates with the positioning holes 52. The glue slot 54 is used for filling glue (not shown in the figure).

More preferably, the inner side surface of the glue slot 54 is in an arc surface structure or a bevel structure or a step structure. The structure is helpful for containing the glue as well as for the glue to flow.

After being filled into the glue slot 54, the glue flows into the gap (not numbered) between the melting point posts 4 and the positioning holes 52 for filling and eliminating the gap along a short axis or long axis of the frame 1, by which the swing of the front cover 5 produced in the related art is reduced and even avoided. Therefore, the front cover 5 is fixed more stably. At the same time, with the gap, the glue can flow to the position between the frame 1 and the front cover 5, such as between the contact surfaces of the frame 1 and the front cover 5, which adds a glue fixing structure for the frame 1 and the front cover 5, so as to increase the fixing strength and stability between the front cover 5 and the frame 1 with the melting points as well as the tensile property of the front cover 5, and therefore the acoustic stability of the sound generator 100 is further optimized.

The side of the body part 51 away from the frame 1 hollows towards the frame 1 to form the melting point groove 55. More preferably, in the embodiment, the positioning holes 52 pass through the melting point groove 55.

The melting point groove 55 can accommodate the melting point posts 4. After being hot pressed to be a locking structure, the melting point posts 4 are accommodated in the melting point groove 55, which both makes the entire sound generator 100 be nice-looking and doesn't need to increase the overall height of the sound generator 100 so as to be helpful for the miniaturization of the product.

To improve the high-frequency acoustic performance of the sound generator 100, in the embodiment, the sound generator 100 also comprises a steel sheet 6 and an air absorbing layer 7, wherein, the steel sheet 6 is fixed on the front cover 5 and fully covers the sound outlet 53, and the air absorbing layer 7 is adhered to and fixed on the steel sheet 6.

The steel sheet 6 is provided with voice outlet 61 which passes through the steel sheet 6 and communicates with the front chamber 10. The air absorbing layer 7 fully covers the voice outlets 61. The Young's modulus of the steel sheet 6 is higher than that of the front cover 5 and therefore the high-frequency acoustic performance of the front chamber 10 can be improved. The air absorbing layer 7 can effectively avoid high-frequency distortion so as to make the acoustic performance of the sound generator 100 be better.

It has to explain that the air absorbing layer 7 in the embodiment is a structure made of a soft material, where air can flow. More preferably, the air absorbing layer 7 is adhered to and fixed on the side of the steel sheet 6 away from the vibration system 2. The configuration doesn't occupy the space of the front chamber 10, which makes the vibration system have enough vibration space.

Compared with the related art, the sound generator of the present disclosure is characterized in that the front cover hollows to form the glue slot which is around and communicated with the positioning holes. After being filled into the glue slot, the glue flows into the gap between the melting point posts and the positioning holes for filling. Therefore the horizontal sway of the front cover is reduced and even avoided, and then the front cover is fixed stably. At the same time, with the gap, the glue can flow to the position between the frame and the front cover, which increases the fixing strength and stability between the front cover and the frame with the melting points as well as the tensile property of the front cover, and therefore the acoustic stability of the sound generator is further optimized.

It is to be understood, however, that even though numerous characteristics and advantages of the present exemplary embodiment have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A sound generator, including;

a frame;

a vibration system and a magnetic circuit system are respectively fixed on the frame, and the magnetic circuit system is used for driving the vibration system to vibrate;

a front cover covering the frame; the front cover and the vibration system cooperatively form a front chamber for radiating sound;

wherein, the frame extends towards the front cover and includes a plurality of melting point posts;

the front cover comprises a body part covering the frame and a plurality of positioning holes passing through the body part and engaging with the melting point posts, the melting point posts being inserted into the positioning holes;

the front cover further comprising an annular glue slot in a side of the body part away from the frame by recessing towards the frame, and the glue slot is around the positioning holes and communicates with the positioning holes for filling glue therein.

2. The sound generator as described in claim 1, wherein the front cover further comprises a melting point groove formed by a side of the body part away from the frame recessing towards the frame; and the positioning holes pass through the melting point groove.

3. The sound generator as described in claim 1, wherein an inner side surface of the glue slot is in an arc surface structure or a bevel structure or a step structure.

4. The sound generator as described in claim 1, wherein four melting point posts are provided and are mutually separated from each other.

5. The sound generator as described in claim 4, wherein the frame is rectangular, and the four melting point posts are respectively arranged at the four corners of the frame.

6. The sound generator as described in claim 1, the front cover further comprises a sound outlet, the sound outlet passes through the body part and communicates with the front chamber for radiating sound.

7. The sound generator as described in claim 6, the sound generator also comprises a steel sheet and an air absorbing layer, the steel sheet is fixed on the front cover and fully covers the sound outlet, and the air absorbing layer is adhered to and fixed on the steel sheet.

8. The sound generator as described in claim 7, the steel sheet is provided with voice outlet which passes through the steel sheet and communicates with the front chamber, the air absorbing layer fully covers the voice outlets.

* * * * *